US009650199B2

(12) United States Patent
Abbosh et al.

(10) Patent No.: US 9,650,199 B2
(45) **Date of Patent: *May 16, 2017**

(54) WIPES BEING FORMED INTO A NON-PLANAR FORM AND DISPENSES FOR STORING SAID WIPES

(75) Inventors: Oday Abbosh, London (GB); Ian Hamilton Dryburgh, Sparsholt (GB); Nigel Lawson, Sevenoaks (GB)

(73) Assignee: Better All Round Limited, London (GB)

( * ) Notice: Subject to any disclaimer, the term of this patent is extended or adjusted under 35 U.S.C. 154(b) by 870 days.

This patent is subject to a terminal disclaimer.

(21) Appl. No.: 13/153,602

(22) Filed: Jun. 6, 2011

(65) Prior Publication Data

US 2011/0232682 A1 Sep. 29, 2011

Related U.S. Application Data

(63) Continuation of application No. 11/813,588, filed as application No. PCT/GB2005/004972 on Dec. 20, 2005, now Pat. No. 7,954,665.

(30) Foreign Application Priority Data

Jan. 10, 2005 (GB) ..... 0500403.1

(51) Int. Cl.

| | |
|---|---|
| ***B08B 1/00*** | (2006.01) |
| ***B29C 53/36*** | (2006.01) |
| ***A47L 25/00*** | (2006.01) |
| ***B65D 83/08*** | (2006.01) |
| *A47K 10/42* | (2006.01) |
| *A47K 10/32* | (2006.01) |

(52) U.S. Cl.

CPC ..... *B65D 83/0894* (2013.01); *A47K 10/426* (2013.01); *A47K 10/421* (2013.01); *A47K 2010/3266* (2013.01); *Y10T 156/1048* (2015.01); *Y10T 428/21* (2015.01); *Y10T 428/24264* (2015.01)

(58) Field of Classification Search

USPC ..... 221/33

See application file for complete search history.

(56) References Cited

U.S. PATENT DOCUMENTS

| | | | | |
|---|---|---|---|---|
| 1,015,085 | A | 1/1912 | Salstrom | |
| 1,398,030 | A | 11/1921 | Luellen | |
| 1,501,662 | A * | 7/1924 | Horwitt | 206/494 |
| 1,503,241 | A | 7/1924 | Horwitt | |
| 1,650,223 | A * | 11/1927 | Martinez | 229/87.01 |
| 1,693,883 | A * | 12/1928 | Barbieri | 221/56 |
| 1,762,977 | A | 6/1930 | Ansley | |

(Continued)

FOREIGN PATENT DOCUMENTS

| | | |
|---|---|---|
| GB | 1 376 403 | 12/1974 |
| GB | 2 361 907 | 7/2001 |

(Continued)

*Primary Examiner* — Gerald McClain
*Assistant Examiner* — Kelvin L Randall, Jr.
(74) *Attorney, Agent, or Firm* — Alan D. Kamrath; Kamrath IP Lawfirm, P.A.

(57) ABSTRACT

A wipe includes a generally flat piece of material (10) made of paper, cloth or the like. The generally flat piece of material (10) is formed into a non-planar form having a three-dimensional shape, for example conical, for storage and dispensing.

16 Claims, 1 Drawing Sheet

(56) References Cited

U.S. PATENT DOCUMENTS

| | | | | | |
|---|---|---|---|---|---|
| 1,915,066 | A | | 6/1933 | Swift | |
| 1,936,203 | A | | 11/1933 | Neu et al. | |
| 2,171,484 | A | | 8/1939 | Squire | |
| 2,321,639 | A | * | 6/1943 | Zarbo | B01D 29/085 131/202 |
| 2,533,815 | A | * | 12/1950 | Kelly | 210/455 |
| 2,552,474 | A | | 5/1951 | Amberg | |
| 2,563,633 | A | | 8/1951 | Amberg | |
| 2,705,089 | A | * | 3/1955 | Bennett | 221/45 |
| 3,019,940 | A | | 2/1962 | Sutton | |
| 3,315,018 | A | | 4/1967 | Commeyras | |
| 3,369,700 | A | | 2/1968 | Nelson | |
| 4,143,762 | A | * | 3/1979 | Spiegelberg | 206/210 |
| 4,166,551 | A | | 9/1979 | Stiros | |
| 4,619,766 | A | * | 10/1986 | Smiley et al. | 210/482 |
| 4,874,112 | A | | 10/1989 | Mulder et al. | |
| 4,931,052 | A | * | 6/1990 | Feldman | A61F 13/551 206/438 |
| 4,940,189 | A | * | 7/1990 | Cremonese | B65D 5/008 141/337 |
| 5,017,174 | A | | 5/1991 | Gowrylow | |
| 5,025,524 | A | * | 6/1991 | Genovese, Jr. | A47K 11/10 118/264 |
| 5,833,680 | A | | 11/1998 | Hartman | |
| D447,346 | S | * | 9/2001 | Abbosh | D5/99 |
| 7,204,390 | B2 | * | 4/2007 | Widlund | 221/47 |
| 7,300,425 | B1 | | 11/2007 | Mants | |
| D747,236 | S | * | 1/2016 | Abbosh | D11/142 |
| D764,968 | S | * | 8/2016 | Abbosh | D11/142 |
| 2002/0068144 | A1 | | 6/2002 | McCumber | |
| 2004/0222582 | A1 | * | 11/2004 | Widlund | 270/32 |
| 2006/0273099 | A1 | | 12/2006 | Abbosh et al. | |

FOREIGN PATENT DOCUMENTS

| | | |
|---|---|---|
| JP | 8256942 | 10/1996 |
| JP | 11076097 | 3/1999 |

* cited by examiner

WIPES BEING FORMED INTO A NON-PLANAR FORM AND DISPENSES FOR STORING SAID WIPES

CROSS REFERENCE

The present application is a continuation of U.S. patent application Ser. No. 11/813,588, now U.S. Pat. No. 7,954,665, having a Sep. 20, 2007 date of completion of all 35 U.S.C. §371 requirements for a national phase of International Application No. PCT/GB2005/004972 filed Dec. 20, 2005.

BACKGROUND

This invention relates to wipes. The term "wipes" is used herein to refer to the kinds of disposable absorbent products known variously as tissues, cloths, paper towels, kitchen roll and the like, which may be made of paper, cloth or any other suitable material and which may be moist, wet or dry and which may be embossed, perforated, quilted or printed or have any other surface decoration or treatment.

Conventional products of this nature, and the dispensers in which they can be stored, are typically not very attractive to look at. Also it is often necessary to use two hands to extract the product from its dispenser. The present invention seeks to improve upon these existing products.

The invention provides a wipe comprising a generally flat piece of material in which said piece of material is formed into a non-planar form having a three-dimensional shape for storage in said shape.

The invention also provides a dispenser for storing a multiplicity of wipes, wherein the dispenser has a body which is adapted to suit the three-dimensional shape of the wipes.

The invention further provides a method of making wipes comprising the steps of producing a generally flat piece of material, forming the piece of material into a non-planar form having a three-dimensional shape and storing the piece of material in said shape.

DESCRIPTION OF THE DRAWINGS

By way of example, embodiments of the invention will now be described with reference to the accompanying drawings, in which.

DESCRIPTION OF THE PREFERRED EMBODIMENTS

Figure 1A:
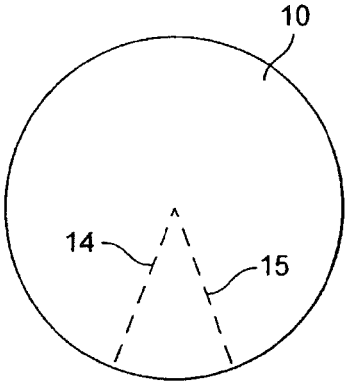
FIGS. 1*a*, 1*b* and 1*c* show a wipe according to the invention in its various stages of formation.

The wipe shown in the drawings is formed initially as a flat round disc 10 of material (FIG. 1*a*). The wipe may comprise a single layer of material, or it may have two or more plies of the same or different materials. Here, the wipe has a laminated construction, with a lower layer 10*a* of absorbent material, such as paper or the like, and an upper layer 10*b* of impervious material, such as glacene paper. Each of the layers 10*a*, 10*b* may comprise one or more plies. The wipe may be impregnated, for example with a scent and/or possibly with an antibacteriological agent. The disc 10 may be formed by any suitable process, such as by being cut from a web of material produced in a continuous process on a machine.

Figure 1B:
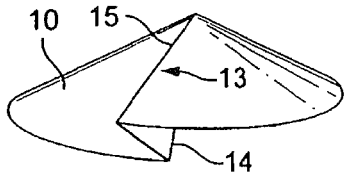
Figure 1C:
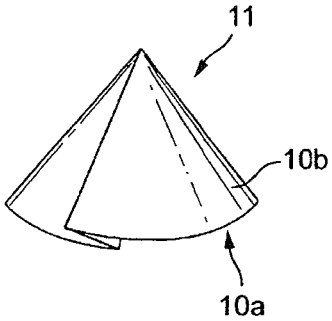

As seen in FIGS. 1*a*, 1*b* and 1*c*, the wipe is transformed from the planar form of disc 10 seen in FIG. 1*a* into the three-dimensional form 11 seen in FIG. 1*c* by tucking in a pleat 13 formed by two radial fold lines 14, 15 in the disc 10. The pleat 13 enables the disc 10 to be partially wrapped over itself, as seen in FIG. 1*b*, which has the effect of drawing it into a conical configuration, as seen in FIG. 1*c*.

By the nature of the material of which it is made, the wipe will tend to remain in its conical configuration once formed, and a number of wipes can thus be stacked one upon another in this configuration. There will be a tendency for the pleat 13 to protrude slightly from the wipe's conical profile, and this provides a useful provision by which a user can readily grasp a wipe from a stack. It will be noted that this can be done using only one hand. When a wipe is to be used to mop up a spillage of liquid on a kitchen top, for example, it can be lifted from a stack by its pleat 13, carried to the spill and simply dropped onto it. When dropped, the wipe will tend to unwrap and return to its original planar form. This transformation will be assisted as the lower layer 10*a* begins to absorb the liquid from the spill. When all the spilt liquid has been absorbed (or when the wipe has become saturated), the wipe can be lifted and disposed of. In this process, the upper layer 10*b* ensures that the user's hand does not become wet or soiled.

Figure 2:
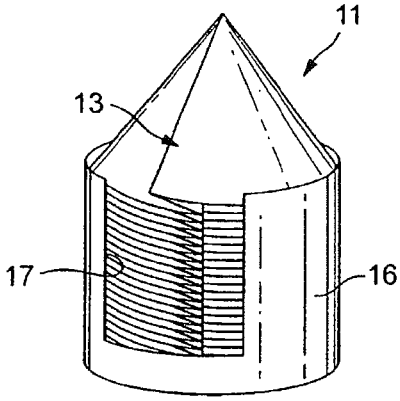
FIGS. 2, 3 and 4 show various forms of dispensers suitable for storing the wipes of FIG. 1*c*.
Figure 3:
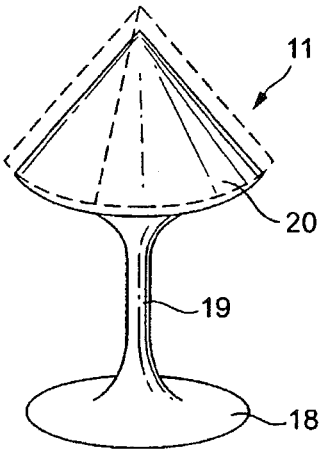
Figure 4:
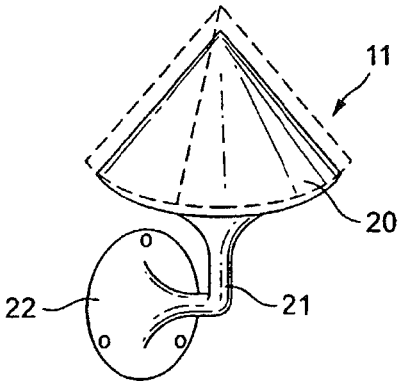

Various dispensers suitable for storing the wipes of FIG. 1*c* are seen in FIGS. 2, 3 and 4. The dispenser of FIG. 2 comprises an essentially round hollow cylindrical body 16 with an internal diameter roughly equal to the overall diameter of the wipes when in their conical form of FIG. 1*c*. A vertical slit 17 in the container body allows access to the pleat 13 of the uppermost wipe in the stack for grasping by a user.

The dispenser of FIG. 3 is in the nature of a free-standing support, with a base 18, a stem 19 and a head 20. The head 20 has a conical configuration to suit the conical configuration of the wipes, which sit upon it.

The dispenser of FIG. 4 is similar to that of FIG. 3 in that it has a conically-shaped head 20 on which the wipes are stacked. Here, however, the head 20 is attached by an elbow 21 to a bracket 22 which enables the dispenser to be mounted on a wall.

A stack of wipes stored and presented in the manner described above offers a more attractive solution for a kitchen than the more traditional forms of paper roller. The arrangement also facilitates use of the wipes, because they can be picked up with just one hand, unlike removing a tissue from a conventional roll of kitchen paper, which often requires two hands. Furthermore, the material and form of the wipe maximise its efficiency and ease of use.

It will be understood that the wipe may be formed initially in any suitable shape, not necessarily a geometric shape, and that it may also be formed into any suitable three-dimensional shape, again not necessarily a geometric one.

The invention claimed is:

1. A method of producing a wipe comprising: providing a generally flat piece of absorbent material having a generally circular shape; forming the piece of material into a non-planar form having a three-dimensional conical shape including an apex and a circular base and defining a hollow interior, with forming the piece of material including folding the piece of material to define a pleat extending from the apex to the circular base and protruding externally slightly from the non-planar form and away from the hollow interior; and storing the piece of material in said non-planar form with said apex arranged above the circular base, with the pleat thereby presenting a ready means for grasping by a user for removing the stored piece of material in said non-planar form.

2. A method as claimed in claim 1 wherein storing the piece of material comprises stacking the piece of material upon another piece of material in said non-planar form with the piece of material abutting with the pleat of the other piece of material protruding externally from the non-planar form.

3. A method as claimed in claim 2 wherein providing the generally flat piece of material comprises producing the piece of material in two or more plies.

4. A method as claimed in claim 2 wherein providing the generally flat piece of material comprises producing the piece of material from two or more different materials.

5. A method of using a wipe comprising: providing a generally flat piece of absorbent material having a generally circular shape; forming the piece of material into a non-planar form having a three-dimensional conical shape including an apex and a circular base and defining a hollow interior; storing the piece of material in said non-planar form with said apex arranged above the circular base; grasping the stored piece of material in said non-planar form and placing the stored piece of material on a spill in said non-planar form having the three-dimensional conical shape including the apex and the circular base and defining the hollow interior; and returning the piece of material in the non-planar form placed on the spill to the generally flat shape after being placed on the spill.

6. A method as claimed in claim 5 wherein forming the piece of material comprises folding the generally circular shape with first and second folds each extending from the apex to first and second points on the circular base, with the first and second folds in the piece of material defining a pleat that protrudes externally slightly from the non-planar form and away from the hollow interior; and wherein storing the piece of material comprises stacking the piece of material in said non-planar form upon and abutting with another piece of material in said non-planar form with the piece of material abutting with the pleat of the other piece of material protruding externally from the non-planar form.

7. A method as claimed in claim 6 wherein providing the generally flat piece of material comprises producing the piece of material in two or more plies.

8. A method as claimed in claim 7 wherein the material of the uppermost ply is impervious.

9. A method as claimed in 6 wherein providing the piece of generally flat material comprises producing the piece of material from impregnated material.

10. A method as claimed in claim 6 wherein forming the piece of material comprises folding two folds in the piece of material each extending radially from the apex, wherein the two folds define a pleat lying externally of the non-planar form allowing the piece of material to be partially wrapped over itself, with grasping the stored piece of material comprising grasping the pleat.

11. A disposable absorbent product comprising a multiplicity of disposable wipes, wherein each wipe comprises a generally flat piece of absorbent material having a generally circular shape, first and second folds in the generally flat piece of material to form the generally flat piece of material into a non-planar form having a three-dimensional conical shape for storage in said non-planar form, with the conical shape including an apex and a circular base defining a hollow interior, with the first and second folds each extending from the apex to first and second points on the circular base, with the first and second folds in the piece of material defining a pleat that protrudes externally slightly from the non-planar form and away from the hollow interior, with the multiplicity of wipes being arranged in a stack one upon the other in succession, with the apex of each wipe arranged above its circular base, with the pleat of the uppermost wipe providing a ready means for grasping by a user, with the uppermost wipe abutting with the pleat of the next wipe in succession in the stack.

12. A disposable absorbent product as claimed in claim 11 wherein the generally flat piece of absorbent material comprises two or more plies.

13. A disposable absorbent product as claimed in claim 11 wherein the generally flat piece of absorbent material is made of two or more different materials.

14. A disposable absorbent product as claimed in claim 11 wherein the generally flat piece of absorbent material includes an impervious upper layer.

15. A disposable absorbent product as claimed in claim 11 wherein the generally flat piece of absorbent material is impregnated.

16. A disposable absorbent product as claimed in claim 11 further comprising a dispenser storing the multiplicity of wipes, wherein a shape of the dispenser suits the non-planar form of the stack of wipes.

* * * * *